US007104894B2

(12) United States Patent
Bennett

(10) Patent No.: US 7,104,894 B2
(45) Date of Patent: Sep. 12, 2006

(54) COMPOSITE MATERIAL FOR EQUESTRIAN SPORTS TRACKS AND THE LIKE

(76) Inventor: Victor George Bennett, The Acacias, 156 Coppermill Road, Wraysbury, Middlesex, TW19 5NR (GB)

( * ) Notice: Subject to any disclaimer, the term of this patent is extended or adjusted under 35 U.S.C. 154(b) by 116 days.

(21) Appl. No.: 10/724,914

(22) Filed: Dec. 1, 2003

(65) Prior Publication Data

US 2004/0198508 A1 Oct. 7, 2004

Related U.S. Application Data

(63) Continuation of application No. PCT/GB02/02576, filed on May 30, 2002.

(30) Foreign Application Priority Data

May 31, 2001 (GB) ..... 0113273.7

(51) Int. Cl.
*A63K 1/00* (2006.01)

(52) U.S. Cl. ..... 472/86; 472/92

(58) Field of Classification Search ..... 472/85–89, 472/92; 119/422

See application file for complete search history.

(56) References Cited

U.S. PATENT DOCUMENTS 6,821,332 B1 * 11/2004 Hubbs ..... 106/272

FOREIGN PATENT DOCUMENTS

| | | | | |
|---|---|---|---|---|
| DE | 200 00 830 | U | | 6/2000 |
| EP | 0 466 514 | A | | 1/1992 |
| GB | 2304348 | A | * | 3/1997 |
| GB | 2313788 | A | * | 12/1997 |
| JP | 06248012 | A | * | 9/1994 |
| WO | WO 89/07635 | | | 8/1989 |

* cited by examiner

*Primary Examiner*—Kien Nguyen
(74) *Attorney, Agent, or Firm*—Gauthier & Connors, LLP

(57) ABSTRACT

A track for equestrian sports and the like, comprising a base layer of compacted polymeric particles, the majority of which have a size in the range from 20–60 mm, an intermediate layer overlying the base layer and comprising compacted polymeric granules whose mean particle size is in a range from 3–25 mm and a top layer comprising finely divided composite particles formed from a thermoplastic polymer, a finely divided filler material such as sand and a wax-based binder. The invention also provides a method of making a particulate material which comprises blending a polymer-coated finely divided filler material with wax and a particulate elastomer, in the presence of an organic solvent.

6 Claims, 2 Drawing Sheets

COMPOSITE MATERIAL FOR EQUESTRIAN SPORTS TRACKS AND THE LIKE

Figure 1:
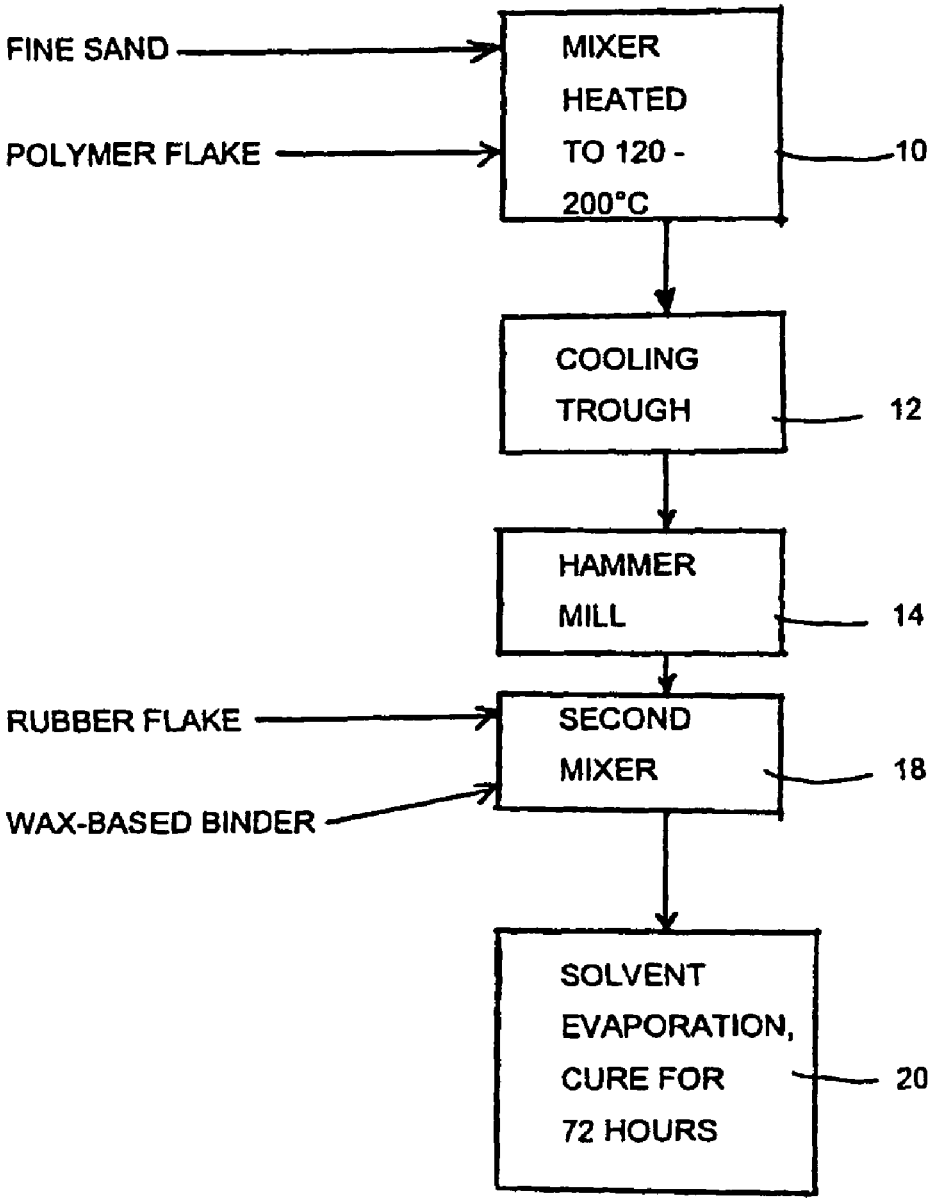

This is a continuation International Application PCT/GB02/02576 filed on May 30, 2002 and which designated the U.S.

This invention relates to composite materials which can be used to form all weather surfaces which are particularly suitable for race courses, jumping arenas and other equestrian facilities.

Equestrian sports, notably racing, are popular throughout the world, and generate large quantities of revenue, especially through betting and television rights. It is therefore important that the surfaces used for such sports are in good condition to enable events to go ahead as planned.

Horses have traditionally been raced on turf, sand or dirt tracks, the condition of which can vary considerably with the weather. Cantering, galloping and jumping put considerable stresses on a horse's forelegs, and it is therefore important that the surface should not be too hard since this greatly increases the risk of injuries, particularly when horses are raced as young as two or three years old and their muscles and joints are not fully mature. At the same time the surface should preferably be not so soft and heavy, that horses tire quickly. While variations in the condition of a course from firm to heavy, are considered by many to add to the interest of betting there is also a risk that a course may become waterlogged or frozen, or maybe so slippery as to he considered to be dangerous, resulting in the cancellation of an event at considerable financial loss.

Various artificial surfaces have also been tried for equestrian sports, notably woodchip or polyvinyl chloride cable granulate, with a view to providing an all weather surface. Synthetic materials have also been blended with silica sand and wax to create waterproof particles to improve surface drainage, but while these surfaces may be less slippery they are still prone to water retention which can result in pooling and dangerous instability. Water retention also renders surfaces prone to freezing in cold weather which is another cause of cancellation of equestrian events.

Water retention also causes inconsistencies in ground compaction, leading to disruptions in a horse's natural stride, adversely affecting its performance and increasing the risk of injury.

Dry surfaces such as turf, soil or sand are also prone to compaction, so that they become too dense and provide little or no cushioning on impact.

Surface dust is a further hazard to both horse and rider since a galloping horse inevitably kicks up large volumes of dust behind it. Regular watering of dry surfaces is therefor needed.

Thoroughbred racehorses can cost millions of pounds, and the inevitably high veterinary fees can become even higher as a result of injuries sustained on inadequate track surfaces.

There is therefore a need for an easily maintained all weather surface, which does not give rise to dust in dry conditions or retain water or freeze following heavy rain.

The surface should retain consistent compaction in all weather conditions, cushioning on impact and subsequently recovering form.

According to a first aspect of the present invention there is provided a track for equestrian sports and the like, comprising a base layer of compacted polymeric particles, preferably of a composite material with an inorganic filler, having a size which is generally in the range from 20 to 60 mm, an intermediate layer overlying the base layer and comprising compacted polymeric granules mean particle size is typically from 3 to 25 mm, preferably 6 to 20 mm, and a top layer comprising composite particles formed from a thermoplastic polymer, a finely divided filler material such as sand and a wax-based binder.

According to a further aspect of the invention, a particulate material is made by blending a polymer-coated finely divided filler material, such as sand, with wax and a particulate elastomer, such as rubber flake in the presence of an organic solvent. The resulting material is particularly suitable for use as the surface material for all-weather tracks in accordance with the invention.

Figure 2:
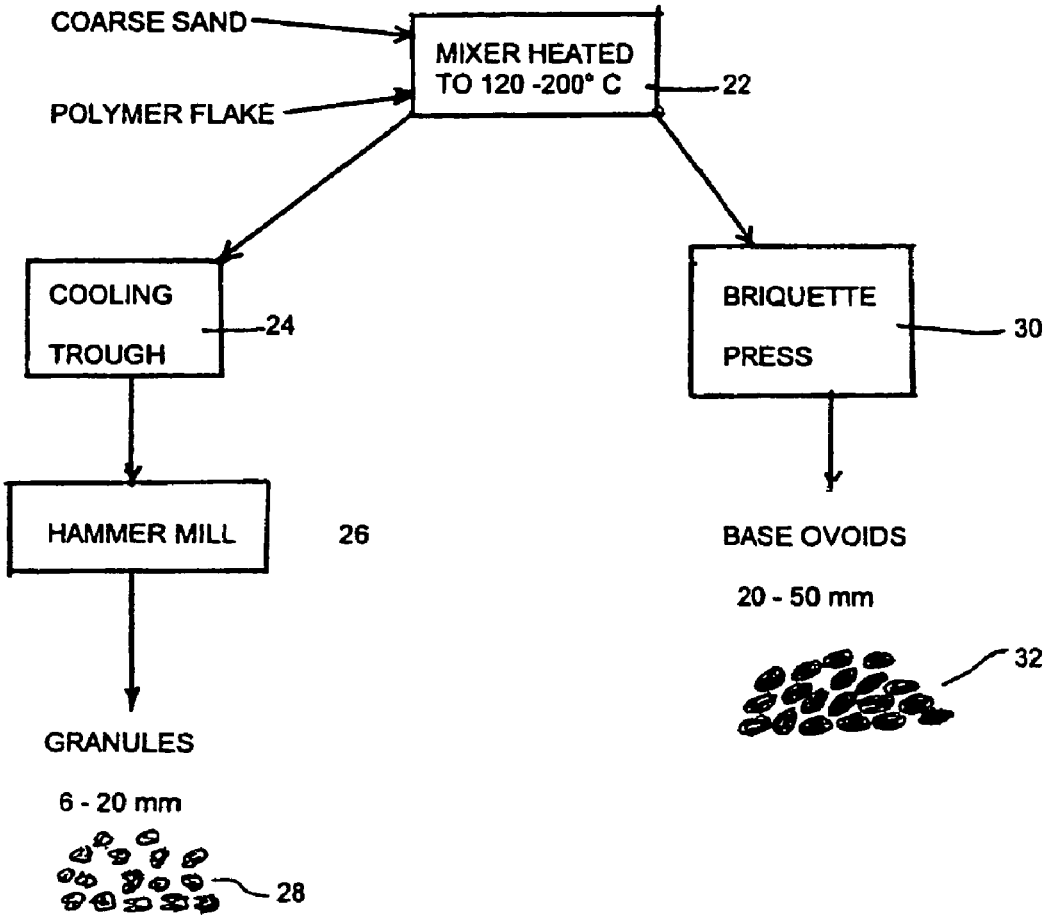

Preferred embodiments of the invention will now be described in more detail with reference to the accompanying drawings wherein:

FIG. 1 is a flow chart illustrating the manufacture of the surface material for a track according to the invention, and FIG. 2 is a flow chart illustrating the manufacture of the material for the base and intermediate layer.

Surface Material

The first stage in the manufacture of the surface material is the formation of a polymer coating on particles of a finely divided filler material, the filler is preferably an inorganic material such as sand. The filler preferably has the majority of its particles in size range from 0.1 to 1 mm.

The material used for the polymer coating is a polymeric flake material, preferably a recycled plastics material.

Suitable polymers include thermoplastic resins such as high and low density polyethylene, polypropylene, polyvinyl chloride, polyesters, polystyrene, copolymers of ethylene and propylene, polyamides, polycarbonates or combinations thereof. The size of the plastic flake may suitably vary from 3 to 30 mm, preferably 6 to 20 mm.

Referring to FIG. 1, in a first step, the friable filler material is charged to a heated mixer 10 at a temperature from 120 to 200° C. The polymeric flake material is then added to the same mixer, and the two components are blended in the heated mixer to give a substantially homogeneous mixture.

The weight ratio of polymer flake to filler will generally be in a range from 2:1 to 1:2, and is preferably in range from 6:4 to 4:6.

The homogeneous mixture of polymer and filler is conveyed from the mixer 10 to a cooling trough 12 where it is cooled to room temperature. It then passes to a size reduction hammer mill 14 or other suitable comminuting means which breaks it down and grades the mix to a fine size particulate with an average particle size which is preferably in a range from 0.5 to 3 mm. The resultant product has a lesser density than for example virgin silica sand or similar friable material.

Once it has been graded to the required particle size, the coated filler is passed to a second mixer 20 in which there has already been blended a mixture of rubber flake and a wax based binder comprising a wax, for example paraffin wax, blended with an environmentally acceptable oil such a liquid vegetable oil and an organic solvent such as ethanol, acetone or carbon tetrachloride which can be easily evaporated off and recycled.

The rubber flake is preferably produced by shredding the tread surfaces of disused vehicle tires. These can be machined by lathe to generate a consistent flake size and thickness which is free of any fibre, fluff or metal content.

The rubber flake and binder are mixed so that the binder adheres to the surface of the rubber flake. When the two are fully blended, the polymer coated sand or other filler material is added to the mixer and blended. Heating is not necessary for this stage.

The weight ratio of rubber to coated filler particles is in a range from 6:4 to 4:6, and the quantities of these two components are preferably approximately equal. The weight ratio of rubber flake to wax binder is suitably from 1.5:1 to 2.5:1, more preferably about 2:1. The most preferred composition comprises approximately two parts rubber, two parts polymer-coated filler and one part wax, all by weight.

The resultant particulate material is conveyed to a holding bay 20, the solvent is evaporated off, and preferably recycled, and the material is left to cure. Curing should be complete within 72 hours, the composition losing its initial tackiness to give a relatively free flowing particulate material having an appearance and consistency similar to that of commercial garden peat or compost, but with a somewhat higher degree of resilience.

Manufacture of Base and Intermediate Layers

The base and intermediate layers of a track according to the invention can be made from the same materials and by similar methods. The manufacturer of these two components is summarised in FIG. 2 of the accompanying drawings.

The first stage of the process is similar to that for production of the surface material. An inorganic filler such as coarse sand is charged to a mixer 22 heated as 120 to 200° C., and polymeric flake material is added and blended with the filler to give a homogeneous mixture.

The preferred polymeric materials, flake sizes and proportions are the same as for the surface material.

If the mixture is to be formed into granules to make up the intermediate layer, it is passed from the heated mixer to a cooling trough 24 where it is cooled to room temperature and solidified, and thence to a size reduction hammer mill 26 where it is broken down into granules 28 whose average size is preferably in a range from 6 to 20 mm. These can be used to form the intermediate layer.

To form the base layer material, the mixture from the heated mixer is passed straight to a briquette press 30 or the like to form it into suitably shaped compacted nuggets 32, preferably having a rounded shape so as to allow plenty of space between them for maximum drainage when the base layer is formed. A suitable press is of the type used for forming anthracite nuts, which impart an ovoid shape with typical dimensions of 45×35×30 mm.

The nuggets forming the base material, with their high density compaction and polymeric surface, have almost zero porosity and high degree of moisture repellance, which greatly assists drainage and water dispersal.

Formation of Track

To install an all weather track in accordance with the invention, the ground is prepared by removal of vegetation and top soil and a base layer of the ovoid shaped nuggets is formed to a thickness which is at least 100 mm and preferably about 200 mm. The intermediate layer of granules of 6 to 20 mm size is laid on top of the base layer to a thickness which is preferably in a range of 100 to 200 mm, suitably about 150 mm. Finally, the surface material is laid on top of the intermediate layer, suitably to thickness of 100 to 200 mm. Provided the layer is at least 150 mm thick, it should be possible for horses to gallop over it without kicking up enough surface material to expose the intermediate layer.

Once the surface material has been laid on the compacted intermediate layer, only light rolling is required to render it ready for use.

The invention claimed is:

1. A track for sports, comprising a base layer of compacted polymeric particles, the majority of which have a size in the range from 20–60 mm, an intermediate layer overlying the base layer and comprising compacted polymeric granules whose mean particle size is in a range from 3–25 mm and a top layer comprising finely divided composite particles formed from thermoplastic polymer, a finely divided filler material.

2. A track according to claim 1 wherein the particles of the base layer are formed of a composite material with an organic filler.

3. A track according to claim 1 wherein the granules of the intermediate layer have a mean particle size in the range from 6–20 mm.

4. A track according to claim 1 wherein the filler material of the top layer has the majority of its particles in a size range from 0.1–1 mm.

5. A track according to claim 1 wherein the track is an equestrian sports track.

6. A track according to claim 1 wherein the finely divided filler material of the top layer is sand and a wax-based binder.

* * * * *